US011070013B2

(12) United States Patent
Brandt

(10) Patent No.: US 11,070,013 B2
(45) Date of Patent: Jul. 20, 2021

(54) OVER-MOLDED COAXIAL CONNECTOR ASSEMBLY

(71) Applicant: TE CONNECTIVITY CORPORATION, Berwyn, PA (US)

(72) Inventor: Christian Perry Brandt, York, PA (US)

(73) Assignee: TE Connectivity Corporation, Berwyn, PA (US)

( * ) Notice: Subject to any disclaimer, the term of this patent is extended or adjusted under 35 U.S.C. 154(b) by 41 days.

(21) Appl. No.: 16/572,738

(22) Filed: Sep. 17, 2019

(65) Prior Publication Data

US 2021/0083440 A1 Mar. 18, 2021

(51) Int. Cl.

| | |
|---|---|
| ***H01R 24/54*** | (2011.01) |
| ***H01R 9/05*** | (2006.01) |
| ***H01R 13/514*** | (2006.01) |
| ***H01R 24/56*** | (2011.01) |
| ***H01R 43/24*** | (2006.01) |
| ***H01R 13/58*** | (2006.01) |
| *H01R 103/00* | (2006.01) |

(52) U.S. Cl.

CPC ..... *H01R 24/542* (2013.01); *H01R 9/0503* (2013.01); *H01R 13/514* (2013.01); *H01R 13/5845* (2013.01); *H01R 24/56* (2013.01); *H01R 43/24* (2013.01); *H01R 2103/00* (2013.01)

(58) Field of Classification Search

CPC .... H01R 24/542; H01R 24/56; H01R 9/0503; H01R 13/514; H01R 13/5845; H01R 43/24; H01R 2103/00

See application file for complete search history.

(56) References Cited

U.S. PATENT DOCUMENTS

| | | | | |
|---|---|---|---|---|
| 6,045,402 | A * | 4/2000 | Embo | H01R 24/50 439/561 |
| 7,465,190 | B2 * | 12/2008 | Henningsen | H01R 9/0521 439/320 |
| 7,766,696 | B2 * | 8/2010 | Conner | H01R 13/518 439/581 |
| 8,147,272 | B2 * | 4/2012 | Rhein | H01R 13/5202 439/556 |
| 8,298,005 | B2 * | 10/2012 | Annequin | H01R 24/50 439/578 |

(Continued)

*Primary Examiner* — Abdullah A Riyami
*Assistant Examiner* — Nader J Alhawamdeh

(57) ABSTRACT

A connector assembly having an outer ground contact and a one piece over-molded housing and a method of assembly. The outer ground contact has an outer contact socket portion and an outer contact termination portion. The outer contact termination portion has openings which extend through a wall of the outer contact termination portion. The one piece over-molded housing has a nose cone portion, an inner dielectric portion and transition portions which extend between the nose cone portion and the inner dielectric portion. The nose cone portion is positioned outside of the outer contact termination portion. The inner dielectric portion positioned inside of the outer contact termination portion. The transition portions extend from the nose cone portion, through the openings, to the inner dielectric portion. The positioning of the transition portions in the openings securely mounts the outer grounding contact to the housing.

19 Claims, 5 Drawing Sheets

(56) References Cited

U.S. PATENT DOCUMENTS

| | | | | |
|---|---|---|---|---|
| 8,430,675 | B2 * | 4/2013 | Hardy | H01R 24/50 439/63 |
| 8,777,636 | B2 * | 7/2014 | Kanda | H01R 43/16 439/63 |
| 9,692,168 | B1 * | 6/2017 | Schroll | H01R 12/721 |
| 10,249,981 | B2 * | 4/2019 | Chen | H01R 13/5219 |

* cited by examiner

OVER-MOLDED COAXIAL CONNECTOR ASSEMBLY

FIELD OF THE INVENTION

The present invention is directed to a connector assembly which has an over-molded housing and a method of manufacturing the assembly. In particular, the invention is directed to a coaxial connector assembly which has a one piece over-molded housing with a dielectric and nose cone and a method of manufacturing the coaxial connector assembly.

BACKGROUND OF THE INVENTION

Coaxial connectors have been used to electrically connect various signal transmission devices. A typical coaxial connector socket includes a generally cylindrical external ground contact surrounding an inner signal contact pin. The ground contact and the signal contact are held together by a dielectric housing. An open end of the cylindrical ground contact defines a receptacle or socket for receiving a mating coaxial plug connector. Terminal leads are provided at a rear or terminating end of the coaxial connector socket, with the terminal leads extending outwardly for connection to a connecting device such as a printed circuit board.

A problem with known coaxial connectors is that they are disproportionately expensive to manufacture and assemble. It would, therefore, be beneficial to provide a connector assembly, and in particular, a coaxial connector assembly which reduces the cost of manufacture and assembly, while providing for a proper electrical connection.

SUMMARY OF THE INVENTION

An embodiment is directed to a coaxial connector assembly having an outer ground contact and a one piece over-molded housing. The outer ground contact has an outer contact socket portion and an outer contact termination portion. The outer contact termination portion has openings which extend through a wall of the outer contact termination portion. The one piece over-molded housing has a nose cone portion, an inner dielectric portion and transition portions which extend between the nose cone portion and the inner dielectric portion. The nose cone portion is positioned outside of the outer contact termination portion. The inner dielectric portion positioned inside of the outer contact termination portion. The transition portions extend from the nose cone portion, through the openings, to the inner dielectric portion. The positioning of the transition portions in the openings securely mounts the outer grounding contact to the housing.

An embodiment is directed to a method of assembling a coaxial connector. The method including: forming an outer contact of the coaxial connector on a carrier strip, the outer contact having openings extending through a wall of the outer contact; and over-molding a housing onto the outer contact while the outer contact is on the carrier strip, the material of the housing flowing through the openings of the outer contact to securely mount the outer contact to the housing.

An embodiment is directed to a method of assembling a connector. The method including: forming a contact of the connector on a carrier strip, the contact having openings extending through a wall of the contact; and over-molding a housing onto the contact while the contact is on the carrier strip, the material of the housing flowing through the openings of the contact to securely mount the contact to the housing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
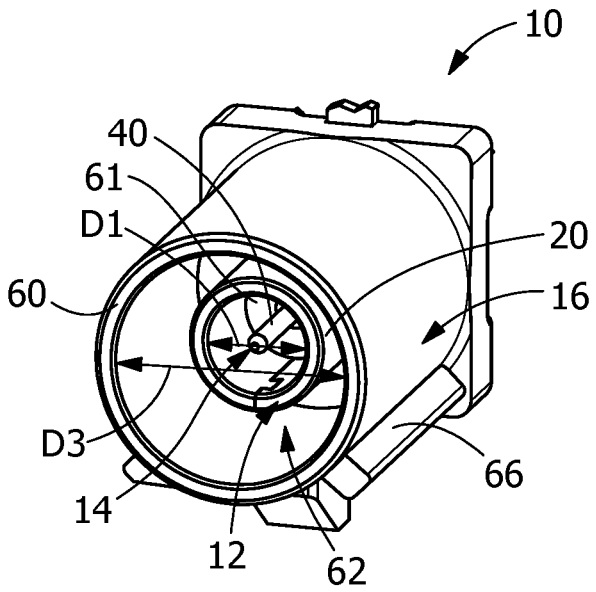
FIG. 1 is a top and side perspective view of an illustrative coaxial connector assembly according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIGS. 1 through 5, a coaxial connector or header assembly 10 has an outer contact 12, a center contact 14 and a dielectric housing 16. In the illustrative embodiment shown, the connector assembly 10 is a vertical header, but other configurations can be used without departing from the scope of the invention.

Figure 2:
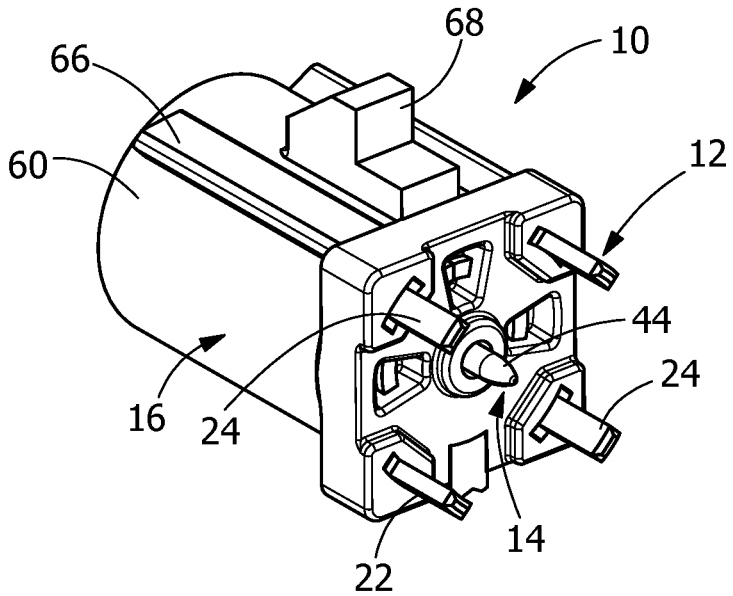
FIG. 2 is a bottom and side perspective view of the illustrative coaxial connector assembly of FIG. 1.

The outer contact 12 is a ground contact. As shown in FIG. 2, the outer contact ground contact 12 has a generally cylindrical shape with an open receptacle or socket portion 20 and an opposed termination portion 22. The socket portion 20 defines a socket or receptacle for receiving a complementary coaxial connector plug (not shown). The termination portion 22 has ground contacts 24 which extend from the socket portion 20 in a direction away from the socket portion 20. In the illustrative embodiment shown, the diameter D1 (FIG. 4) of the cylindrical socket portion 20 is smaller than the diameter D2 (FIG. 3) of the termination portion 22. However, other configurations may be used.

In the illustrative embodiment shown, four ground contacts 24 are provided which are configured to make electrical engagement with grounding areas of a substrate (not shown). In the illustrative embodiment shown, the ground contacts 24 are configured to be inserted into through holes of the substrate, however, the ground contacts may also be configured to be surface mounted on the substrate. Alternate numbers of ground contacts 24 may be provided.

Figure 3:
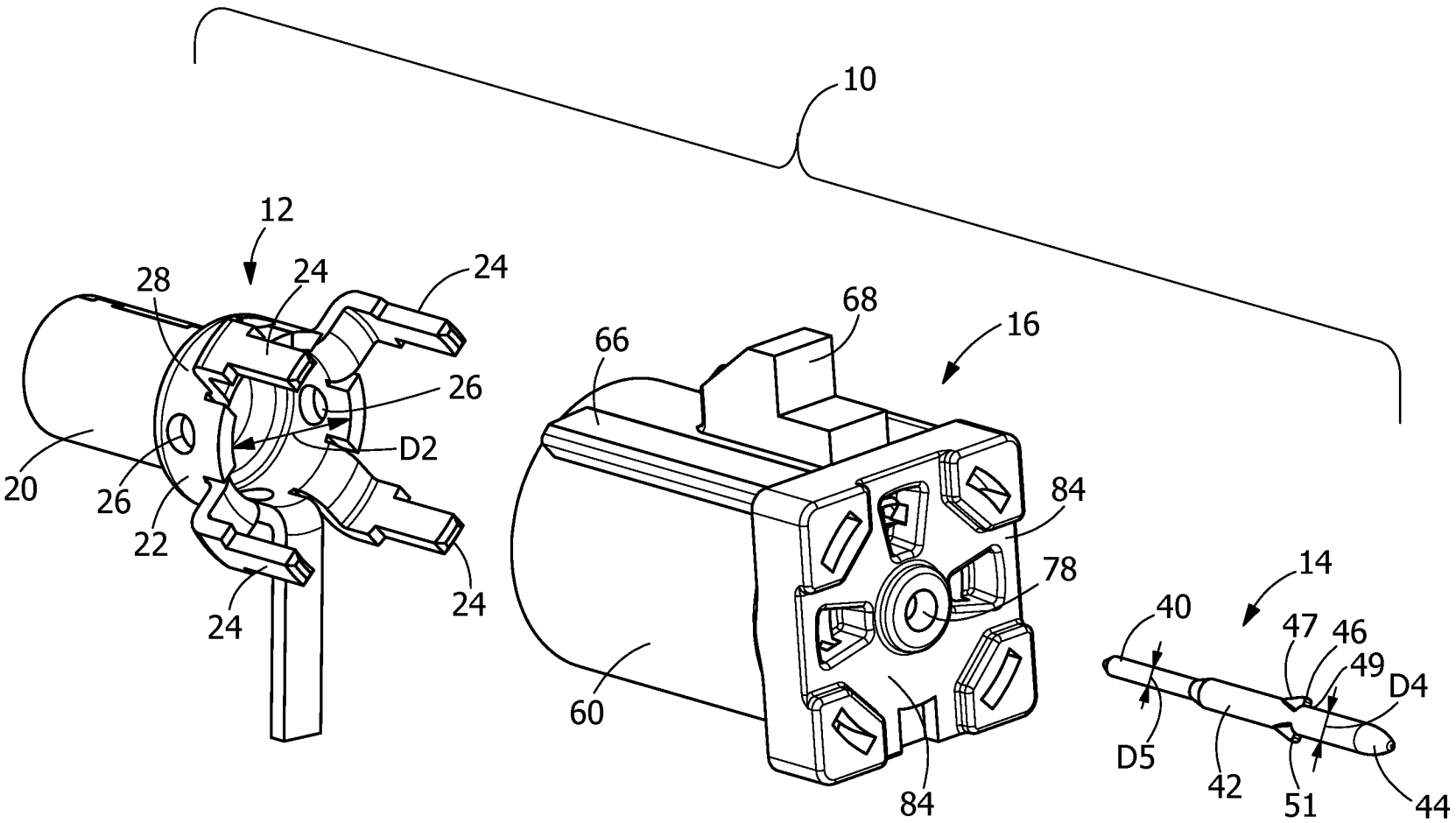
FIG. 3 is an exploded perspective view of the illustrative of the coaxial connector assembly of FIG. 1, with a center contact and outer contact exploded from the housing.
Figure 4:
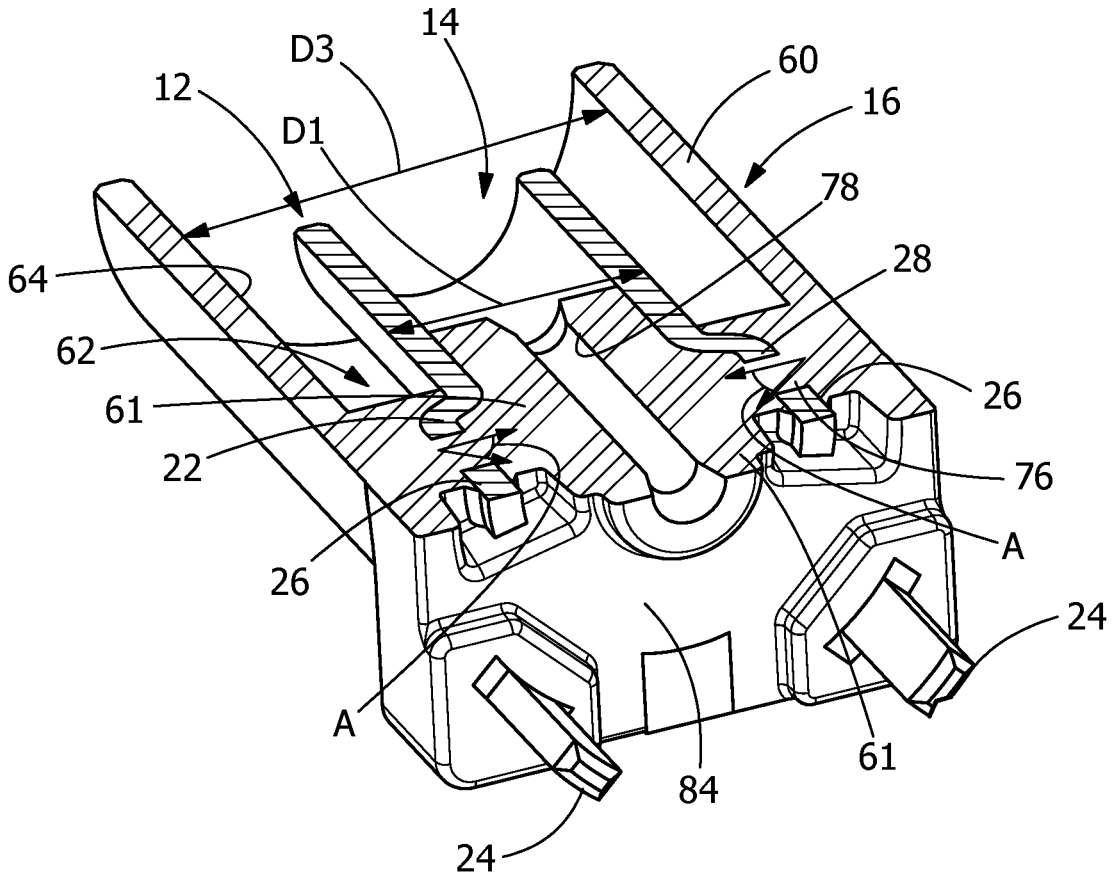
FIG. 4 is a cross-sectional of the over-molded coaxial connector assembly taken along a longitudinal axis of the housing.
Figure 5:
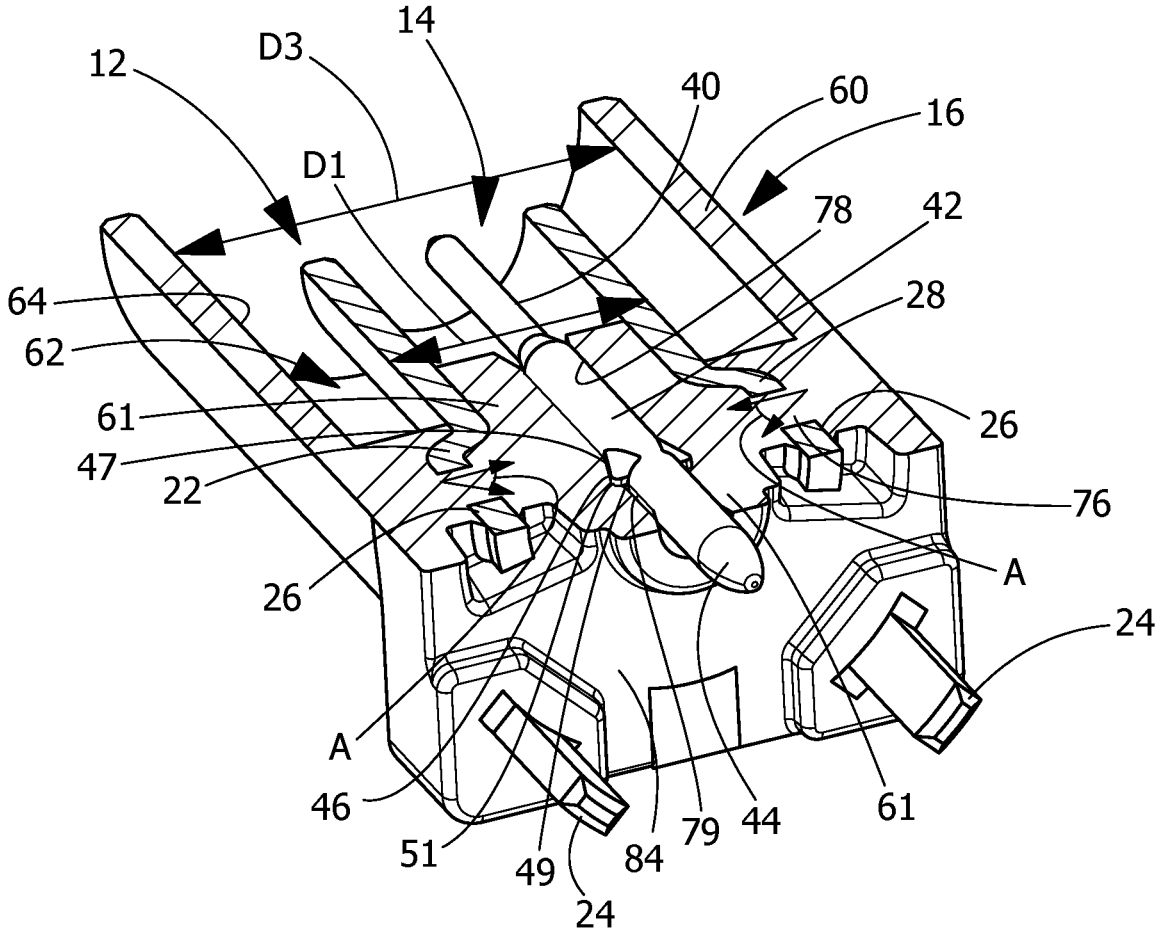
FIG. 5 is a cross-sectional of the coaxial connector assembly of FIG. 4 with the center contact properly positioned.

As shown in FIGS. 3 through 5, openings 26 extend through a wall 28 of the termination portion 22. The openings 26 are positioned periodically about the circumference of the termination portion 22. In the illustrative embodiment shown, four openings 26 are stamped or formed in the wall 28, with the openings 26 positioned between the ground contacts 24. However, other numbers, positioning and/or configurations of the openings may be used.

The center contact 14 is a signal contact. Referring to FIGS. 1, 3 and 5, the center contact 14 has a mating portion 40, a mounting portion 42 and a termination portion 44. The mounting portion 42 is positioned between the mating portion 40 and the termination portion 44. In the illustrative embodiment shown, the mounting portion 42 and the termination portion 44 have a diameter D4 greater than the diameter D5 of the mating portion 40. However, other configurations may be used.

The mating portion 40 extends into the socket portion 20 of the outer contact 12 for mating with the a complementary coaxial connector plug (not shown). The termination portion 44 extends from the mounting portion 42 in a direction away from the mating portion 40. The termination portion 44 is configured to make electrical engagement with signal traces or areas of a substrate (not shown). In the illustrative embodiment shown, the termination portion 44 is configured to be inserted into a through hole of the substrate, however, the termination portion 44 may also be configured to be surface mounted on the substrate.

Projections or barbs 46 are provided on the mounting portion 42. In one embodiment, a barb 46 has a ramp portion 47 and a surface portion 49. The surface portion 49 is perpendicular or approximately perpendicular to the longitudinal axis of the center contact 14. The ramp portion 47 and the surface portion 49 meet a point 51. The barbs 46 are configured to engage the housing 16 to secure and retain the center contact 14 in position relative to the housing 16 and relative to the outer contact 12, as will be more fully described.

Figure 7:
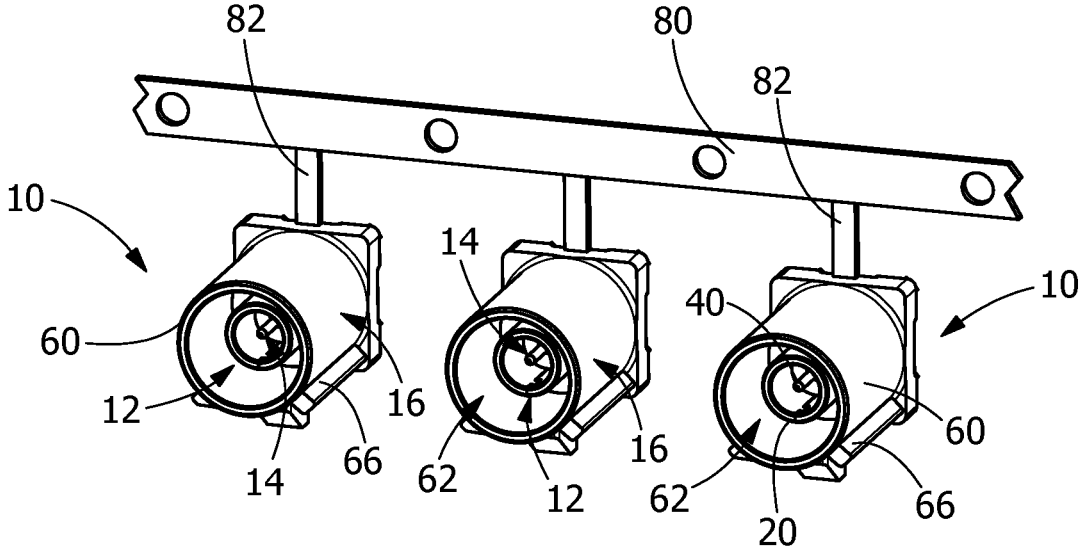
FIG. 7 is a perspective view of the outer contacts of FIG. 6 with the housing over-molded onto the outer contacts and the center contacts positioned in the housing.

As shown in FIGS. 1, 3 and 7, the housing 16 has cylindrical socket or nose cone portion 60 and a dielectric inner portion 61 (FIG. 4) which is positioned between the outer contact 12 and the center contact 14. The cylindrical socket portion 60 has an inner diameter D3 which is greater than the diameter D1 of the socket portion 20 of the outer contact 12 to provide a cavity or space 62 between the outer contact 12 and an inner wall 64 of the cylindrical socket portion 60 of the housing 16. The cavity 62 is configured to receive the complementary coaxial connector plug (not shown).

Keying ribs 66 may optionally be provided on the cylindrical socket portion 60 of the housing 16 to properly align the complementary coaxial connector plug with the coaxial connector assembly 10. A locking nose or projection 68 may also optionally be provided to cooperate with the complementary coaxial connector plug to secure the complementary coaxial connector plug to the coaxial connector assembly 10.

As shown in FIG. 4, the housing 16, made of dielectric material, is interengaged with outer contact 12. The housing 16 is preferably a plastic material which is over-molded in one piece around the outer contact 12, whereby the nose cone portion 60 and the dielectric inner portion 61 are molded in the same process with the same material. The housing 16 includes transition portions 76 which extend between the nose cone portion 60 and the dielectric inner portion 61.

The nose cone portion 60 is positioned outside of the termination portion 22 of the outer contact 12. The dielectric inner portion 61 is positioned inside of the termination portion 22 of the outer contact 12. The dielectric inner portion 61 has a center contact receiving opening 78 which extends through the dielectric inner portion 61 along a longitudinal axis of the dielectric inner portion 61 and a longitudinal axis of the coaxial connector assembly 10. The transition portions 76 extend from the nose cone portion 60 through the openings 26 and to the dielectric inner portion 61.

Figure 6:
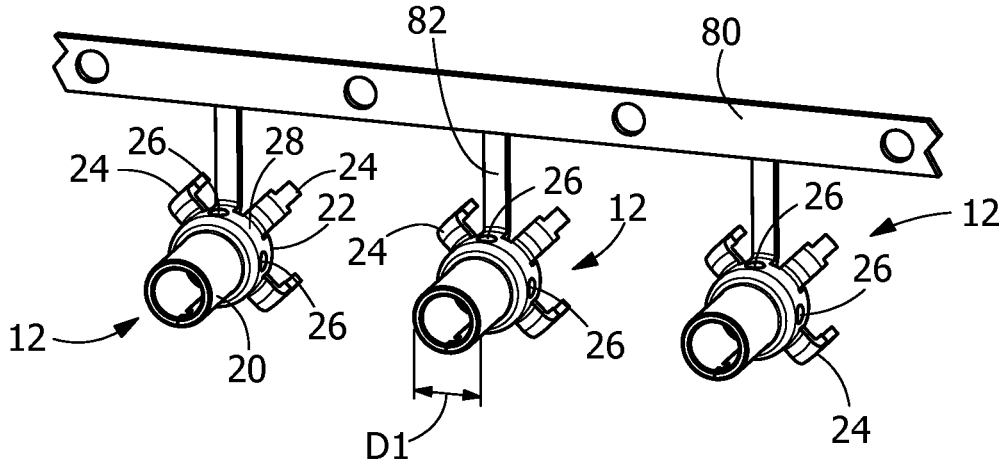
FIG. 6 is a perspective view of several outer contacts stamped and formed on a carrier strip.

As shown in FIGS. 6 and 7, the outer contact 12 is first stamped and/or formed on a carrier strip 80. Each formed outer contact 12 is maintained on the carrier strip 80 by retention strips 82.

With the outer contact 12 properly formed and retained on the carrier strip 80, the housing 16 is over-molded onto the outer contacts 12 and is formed into the configuration described above, with the nose cone portion 60 and the dielectric inner portion 61. As the housing 16 is over-molded over the outer contact 12, the material of the housing 16 flows through the openings 26 and hardens or cures when properly positioned. In so doing, the outer contact 12 is securely fixed in the housing 16.

During the over-molding, molten material of the housing 16 flows through the openings 26 in the outer contacts 12, as represented by the arrows A in FIG. 4. By over-molding and properly securing the housing 16 onto the outer contacts 12, no additional and separate components are needed.

Consequently, the present invention eliminates the need to develop and manufacture intricate assembly features, such as, but not limited to, latches, to join the housing 16 to the outer contact 12. In addition, as the housing 16 and outer contact 12 are integrally joined by over-molding, the risk of the housing 16 and/or outer contact 12 cracking, disassembling, or becoming loose during use are significantly reduced as compared to known coaxial connectors, thereby significantly reducing failures of the coaxial connectors 10. The need for tolerance control is also reduced by the present invention. As known coaxial connectors require more individual components to be assembled, each component must be precisely manufactured within specified tolerances to ensure proper assembly. In contrast, as the present invention is over-molded, cumulative tolerance concerns are eliminated.

With the housing 16 properly over-molded onto the outer contact 12, and the assembled housing 16 and outer contact 12 retained on the carrier strip 80, the center contact 14 is inserted through a rear surface 84 of the housing 16 into the center contact receiving opening 78, as shown in FIGS. 5 and 7. In this position, the projections 46 of the mounting portion 42 of the center contact 14 engage and displace material of the wall 79 of the center contact receiving opening 78. The surface portions 49 and the points 51 of the projections 46 dig into the walls of the center contact receiving opening 78 to secure and retain the center contact 14 in the housing 16.

In an alternative embodiment, the center contact 14 may be positioned in the outer contact 12 and retained in position relative thereto prior to the housing 16 being over-molded. In this embodiment, the housing 16 is over-molded around the outer contact 12 as described above and the dielectric inner portion 61 of the housing 16 is over-molded over the center contact 14 to retain the center contact 14 in the dielectric inner portion 61 of the housing 16 and in the outer contact 12.

With the outer contact 12, center contact 14 and housing 16 properly assembled, the coaxial connector 10 is removed from the carrier strip 80 and the retention strip 82 is removed from the coaxial connector 10.

Although the connector assembly and method are described with respect to the illustrative coaxial connector assembly, the method of over-molding the housing on the contact while the contact is attached to the carrier strip as described above can be used with other types of contacts and other types of connector assemblies.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A coaxial connector assembly comprising:

an outer ground contact having an outer contact socket portion and an outer contact termination portion, the outer contact termination portion having openings which extend through a wall of the outer contact termination portion;

a one piece over-molded housing having a nose cone portion, an inner dielectric portion and transition portions which extend between the nose cone portion and the inner dielectric portion, the nose cone portion positioned outside of the outer contact termination portion, the inner dielectric portion positioned inside of the outer contact termination portion, and the transition portions extend from the nose cone portion, through the openings, to the inner dielectric portion;

wherein the positioning of the transition portions in the openings securely mounts the outer grounding contact to the housing.

2. The coaxial connector assembly of claim 1, wherein the outer contact socket portion of the outer ground contact is cylindrical.

3. The coaxial connector assembly of claim 1, wherein the outer contact termination portion has grounding contacts which extend from the housing in a direction away from the nose cone portion.

4. The coaxial connector assembly of claim 1, wherein the outer contact termination portion has a diameter which is larger than a diameter of the inner dielectric portion.

5. The coaxial connector assembly of claim 1, wherein a diameter of the outer contact socket portion is smaller than a diameter of the outer contact termination portion.

6. The coaxial connector assembly of claim 1, wherein the nose cone portion is cylindrical.

7. The coaxial connector assembly of claim 6, wherein the nose cone portion has an inner diameter which is greater than a diameter of the outer contact socket portion.

8. The coaxial connector assembly of claim 7, wherein a cavity is provided between the outer ground contact and an inner wall of the nose cone portion.

9. The coaxial connector assembly of claim 1, wherein keying ribs are provided on the nose cone portion to properly align a complementary coaxial connector plug with the coaxial connector assembly.

10. The coaxial connector assembly of claim 1, wherein a locking projection is positioned on the nose cone portion to cooperate with the complementary coaxial connector plug to secure the complementary coaxial connector plug to the coaxial connector assembly.

11. The coaxial connector assembly of claim 1, wherein the inner dielectric portion has a center contact receiving opening which extends through the inner dielectric portion along a longitudinal axis of the inner dielectric portion and a longitudinal axis of the coaxial connector assembly.

12. The coaxial connector assembly of claim 11, wherein a center signal contact is positioned in the center contact receiving opening.

13. The coaxial connector assembly of claim 12, wherein the center contact has a contact mating portion, a contact mounting portion and a contact termination portion, the contact mounting portion is positioned between the contact mating portion and the contact termination portion.

14. The coaxial connector assembly of claim 13, wherein the contact mounting portion and the contact termination portion have a diameter greater than the diameter of the contact mating portion.

15. The coaxial connector assembly of claim 14, wherein the contact mounting portion has projections configured to engage a wall of the center contact receiving opening to secure and retain the center contact in position relative to the housing and relative to the outer ground contact.

16. A method of assembling a coaxial connector, the method comprising:

forming an outer contact of the coaxial connector on a carrier strip, the outer contact having openings extending through a wall of the outer contact;

over-molding a housing onto the outer contact while the outer contact is on the carrier strip, the material of the housing flowing through the openings of the outer contact to securely mount the outer contact to the housing;

forming an outer portion, an inner portion and transition portions in the housing, the outer portion positioned outside of the outer contact, the inner portion positioned inside of the outer contact, and the transition portions extending from the outer portion, through the openings, to the inner portion.

17. The method as recited in claim 16, further comprising: forming a center contact receiving opening in the inner portion of the housing; inserting and securing a center signal contact in the center contact receiving opening while the while the outer contact and the housing are on the carrier strip.

18. The method as recited in claim 17, further comprising:

positioning and maintaining a center signal contact relative to the outer contact prior to over-molding the housing;

wherein as the housing is over-molded onto the outer contact, an inner dielectric portion of the housing is over-molded over the center signal contact to retain the center signal contact in the inner dielectric portion of the housing and in the outer contact.

19. A method of assembling a connector, the method comprising:

forming a contact of the connector on a carrier strip, the contact having openings extending through a wall of the contact;

over-molding a housing onto the contact while the contact is on the carrier strip, the material of the housing flowing through the openings of the contact to securely mount the contact to the housing;

forming an outer portion, an inner portion and transition portions in the housing, the outer portion positioned outside of the contact, the inner portion positioned inside of the contact, and the transition portions extending from the outer portion, through the openings, to the inner portion.

* * * * *